US009538810B2

(12) United States Patent
Kow

(10) Patent No.: US 9,538,810 B2
(45) Date of Patent: Jan. 10, 2017

(54) ELECTROSTATIC DISCHARGE SHOE ASSEMBLY AND ELECTROSTATIC DISCHARGE SHOE GROUNDING ACCESSORY THEREOF

(71) Applicant: ESD TECHNOLOGY CONSULTING & LICENSING CO., LTD, Shenzhen, Guangdong (CN)

(72) Inventor: Kek Hing Kow, Shenzhen (MY)

(73) Assignee: ESD TECHNOLOGY CONSULTING & LICENSING CO., LTD, Shenzhen (CN)

( * ) Notice: Subject to any disclaimer, the term of this patent is extended or adjusted under 35 U.S.C. 154(b) by 111 days.

(21) Appl. No.: 14/352,689

(22) PCT Filed: Oct. 22, 2012

(86) PCT No.: PCT/CN2012/083292
§ 371 (c)(1),
(2) Date: Apr. 18, 2014

(87) PCT Pub. No.: WO2013/056682
PCT Pub. Date: Apr. 25, 2013

(65) Prior Publication Data

US 2014/0254059 A1 Sep. 11, 2014

(30) Foreign Application Priority Data

Oct. 20, 2011 (WO) ..... PCT/CN2011/081005

(51) Int. Cl.
*H05F 3/02* (2006.01)
*A43B 7/36* (2006.01)
(Continued)

(52) U.S. Cl.
CPC ..... *A43B 7/36* (2013.01); *A43C 19/00* (2013.01); *A43B 3/163* (2013.01)

(58) Field of Classification Search
USPC ..... 361/223
See application file for complete search history.

(56) References Cited

U.S. PATENT DOCUMENTS 3,459,997 A * 8/1969 Legge ..... A43B 7/36 361/223
4,249,226 A 2/1981 Westberg et al.
(Continued)

FOREIGN PATENT DOCUMENTS

DE 19716332 A1 10/1998
IE GB 191016183 A * 9/1910 ..... A43B 5/18
(Continued)

OTHER PUBLICATIONS

International Search Report of PCT Application No. PCT/CN2012/083292.
(Continued)

*Primary Examiner* — Ann Hoang

(57) ABSTRACT

An electrostatic discharge shoe grounding accessory comprises an attachment mechanism (2) and a fastening mechanism, wherein, the attachment mechanism (2) is a U-shape holder attached to the back wall of an opening rim of the shoe, and the fastening mechanism includes at least one smaller loop through (5) which a front portion of the shoe is hitched. An electrostatic discharge shoe assembly comprises a shoe and the electrostatic discharge shoe grounding accessory.

3 Claims, 6 Drawing Sheets

(51) Int. Cl.
*A43C 19/00* (2006.01)
*A43B 3/16* (2006.01)

(56) References Cited

U.S. PATENT DOCUMENTS

| | | | | | |
|---|---|---|---|---|---|
| 4,551,783 | A | | 11/1985 | Cohen et al. | |
| 4,812,948 | A | | 3/1989 | Bird et al. | |
| 5,697,128 | A | * | 12/1997 | Peregrine | F16G 11/10 24/115 G |
| 5,909,945 | A | * | 6/1999 | Noy | A43C 15/00 152/208 |
| 6,343,776 | B1 | * | 2/2002 | Coon | G09F 7/18 248/317 |
| 2003/0231454 | A1 | * | 12/2003 | Hee | A43B 7/36 361/223 |
| 2007/0163146 | A1 | * | 7/2007 | Brovkin | A43C 15/10 36/7.6 |

FOREIGN PATENT DOCUMENTS

| | | | |
|---|---|---|---|
| JP | 11-75902 | A | 3/1999 |
| KR | 20100008914 | U | 9/2010 |

OTHER PUBLICATIONS

International Search Report of PCT Application No. PCT/CN2011/081005.

* cited by examiner

ELECTROSTATIC DISCHARGE SHOE ASSEMBLY AND ELECTROSTATIC DISCHARGE SHOE GROUNDING ACCESSORY THEREOF

FIELD OF THE INVENTION

The present invention relates to ESD (electrostatic discharge) technique, and, more specific, to an electrostatic discharge shoe assembly and electrostatic discharge shoe grounding accessory thereof.

BACKGROUND OF THE INVENTION

Across the electronics manufacturing industry, it is common that ESD (electrostatic discharge) shoes are increasingly being used as one of the practical and effective tools in the combat against the electrostatic discharge damage threat in a typical microchip manufacturing work station. ESD shoe that described in the current invention is referring to any footwear that exhibits an electrical property that falls within the range of $1\times10e^{3}$ to $1\times10e^{11}$ ohm as measured according to the ANSI/ESD STM 11.11 (USA).

In such highly competitive and cost-conscious nature of the electronics assembly activities, there also exists a continual need to develop new or better technology that can replace or bring down the cost of an ESD shoes.

There are numerous prior arts that touch and emphasize on the use of shoe grounding device or attachment in the ESD footwear industry and some of them include the followings.

U.S. Pat. No. 4,249,226 highlights an electrically conductive strap that secured to an ordinary shoe to ground static electricity accumulated on the body of a person. However, the L-shaped conductive adhesive strap provide weak adhesion onto the bottom surface of the shoe sole during walking as there is no adequate structural design to hold the tip-end of such L-shaped design.

U.S. Pat. No. 4,812,948 highlights a shoe ground strap with an electrostatic discharge exposed surface and offers protection against static charges building on the wearer and offers protection against electrical hazards if contacting a source of electrical power. However, the "improved" conductive ground strap still clearly inhibits defects. There are loose spaces between the adhesive tape and the side wall of the shoe sole. Such loose space lacks adhesion integrity & become a "defective spot". Longer use can lead to dust & contaminants accumulation on the exposed adhesive surfaces especially used in wet floor like washroom, toilet, etc resulting in cross-contamination particularly in a cleanroom. Such loose space also promote poor bonding between the electrostatic discharge strap and the bottom surface of the shoes during normal walking or brisk walk especially in some demanding rough floor condition, giving rise to "delamination" of the electrostatic discharge strap, exposing the adhesive surface & can cause direct contamination on the floor of the workplace.

KR2010008914U discloses an electrostatic removal device comprising a U-shape foot wear holder attached to the back of an opening rim of the shoe and a thunderon fiber connecting a ground copper contact and a shoe copper contact. The whole electrostatic removal device is lodged to the back of an opening rim of the shoe, then the ground copper contact 2 is grounded and the shoe copper contact 3 contact the bottom of the shoe.

However, the electrostatic removal device not only exhibit weak fastening capability due to lack of strong structure support at the bottom of the shoe sole, it is also not suitable for use in shoe with rough and uneven bottom shoe sole design.

This gives rise to further research and development on ESD grounding strap used on the shoe with the objective of overcoming those shortcomings as highlighted above and yet able to achieve a favorable cost advantage.

SUMMARY OF THE INVENTION

The primary objective of this invention is to provide a unique electrostatic discharge shoe grounding accessory that is simple, low cost and easy to attach onto a shoe to electrically bridge the body of a wearer and a ground in draining away the static charge that resides on the body of a person.

The electrostatic discharge shoe grounding accessory according to present invention, comprising an attachment mechanism and a fastening mechanism, wherein, the attachment mechanism is a U-shape holder attached to back wall of an opening rim of the shoe, and the fastening mechanism includes at least one smaller loop through which the front portion of the shoe is hitched.

Optionally, the fastening mechanism is an one-piece electrostatic discharge loop that is tied or joined at least once so as to form at least a first smaller loop and a second smaller loop, wherein, the attachment mechanism is formed on the first smaller loop resting on an insole inside the shoe and the second smaller loop hitches onto the front portion of the shoe.

Optionally, the fastening mechanism is an one-piece electrostatic discharge loop that is tied or joined twice so as to form a first smaller loop, a second smaller loop and a third smaller loop, wherein, the attachment mechanism is formed on the first smaller loop resting on an insole inside the shoe, the second smaller loop hitches onto the back portion of the shoe and the third smaller loop hitches onto the front portion of the shoe.

Optionally, the fastening mechanism is an one-piece electrostatic discharge loop that is tied or joined three times so as to form a first smaller loop, a second smaller loop, a third smaller loop and a fourth smaller loop, wherein the attachment mechanism is formed on the first smaller loop resting on an insole inside the shoe, the second smaller loop hitches onto the back portion of the shoe, the third smaller loop hitches onto the front portion of the shoe and the fourth smaller loop hitches onto the extreme front portion of the shoe.

Optionally, the fastening mechanism comprises a tail portion resting on an insole inside the shoe, at least one smaller loop through which the front portion of the shoe is hitched, and a connection portion along the bottom of the shoe sole connecting the tail portion and the smaller loop, wherein, the attachment mechanism is formed on the tail portion.

Optionally, the fastening mechanism comprises a tail portion resting on an insole inside the shoe, a first smaller loop through which the back portion of the shoe is hitched, a second smaller loop through which the front portion of the shoe is hitched, and a connection portion connecting the tail portion and the second smaller loop or connecting the first smaller loop and the second smaller loop, wherein, the attachment mechanism is formed on the tail portion.

Optionally, the tail portion is a conductive micro-spring loop, a conductive wire or a piece of conductive polymer with an electrical resistance of less than $1\times10e^{6}$ ohms, the connection portion is made of one or two steel wires.

Optionally, the smaller loop at the front portion of the shoe connecting the connection portion comprises a spring loop installed with an elastic thread for preventing over stretching of the spring loop, and the connection portion is provided with at least one micro spring for adjusting the size of the smaller loop connected.

Optionally, the U-shape holder comprises a steel wire with two sharp wire ends for piercing through fabric just above a back wall heel region of the openings rim of a boot to form two small hooks to hook up a resistor holder.

The secondary objective of this invention is to provide an electrostatic discharge shoe assembly, which comprising at least one of the above described electrostatic discharges shoes grounding accessories.

In that way, the invention provide an uniquely simple & a low-cost means to produce an electrostatic discharge shoe assembly and electrostatic discharge shoe grounding accessory thereof to effectively drain static charge from the body of a person to ground overcoming the numerous shortcomings of the existing prior arts cited in the background of the current invention.

The smaller loops of the fastening mechanism start at the bottom sole region are obviously uncommon. Such unusual attachment methodology starting from the bottom of the shoe and ending up at the top front of the footwear is technically so different compared to all the cited prior combined. When taken this unique attachment technique together with the U-shape holder as a whole, there is a big technical improvement. This new design achieve not only a more secure and easier attachment methodology, it also cheaper and faster to produce as it has no fastening parts like rivet, velcro, stitching or other mechanical attachment except the loop formed from the slit together with a bendable U-shape holder. This is as a whole clearly demonstrates the novelty and the non obviousness of the current invention compared to all the cited prior art.

BRIEF DESCRIPTION OF THE DRAWINGS

So as to further explain the invention, an exemplary embodiment of the present invention will be described with reference to the below drawings, wherein.

DETAILED DESCRIPTION OF THE PREFERRED EMBODIMENT

These and other advantage, aspect and novel features of the present invention, as well as details of an illustrated embodiment thereof will be more fully understood from the following description and drawings, while various embodiments of the present invention are presented by way of examples only, not limitation.

Figure 1:
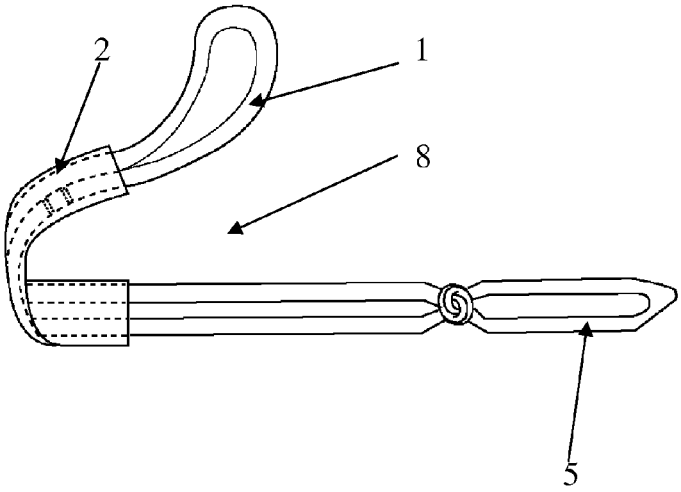
FIG. 1 is a diagram of a first embodiment of the electrostatic discharge shoe grounding accessory according to the present invention.

FIG. 1 is a diagram of a first embodiment of the electrostatic discharge shoe grounding accessory according to the present invention. As shown in FIG. 1, the electrostatic discharge shoe grounding accessory according to present invention consists of a one-piece continuous electrostatic discharge loop 8 with unique design that conveniently attached onto the shoe without the use of velcro or adhesive means commonly practiced in the ESD control industry to achieve the objective of draining away static charge from body to ground quickly and safely.

The one-piece continuous electrostatic discharge loop 8 comprises an attachment mechanism 2 and a fastening mechanism. The attachment mechanism 2 is a U-shape holder attached to back wall of an opening rim of the shoe, and the fastening mechanism includes at least one smaller loop 5 through which the front portion of the shoe is hitched.

Referring to FIG. 1, this unique attachment mechanism 2 is an easy-to-use adjustable flexible U-shape loop holder and the fastening mechanism is a one-piece electrostatic discharge loop that is tied or joined at least once so as to form at least a first smaller loop 1 and a second smaller loop 5. The attachment mechanism 2 is formed on the first smaller loop 1 resting on an insole inside the shoe and the front portion of the shoe is hitched through the second smaller loop 5. When putting the shoe grounding accessory on, the easy-to-use adjustable flexible U-shape loop holder is attached to back wall of an opening rim of the shoe, so the first smaller loop 1 of the one-piece continuous electrostatic discharge loop 8 is resting on the insole inside the shoe, the second smaller loop 5 hitches the front portion of the shoe, and the rest of the one-piece continuous electrostatic discharge loop 8 is beneath the bottom shoe sole.

Optionally, a highly conductive element 6 of less than $1\times10^3$ ohm measured according to ANSI/ESD S202.20 standard (USA) such as a conductive thread, strip or wire is attached to the one-piece continuous electrostatic discharge loop 8 outside the shoe at the region beneath a bottom sole of the shoe and contacted with a floor.

In that way, the invention provide an uniquely simple & a low-cost means to produce an electrostatic discharge shoe assembly to effectively drain static charge from the body of a person to ground overcoming the numerous shortcomings of the existing prior arts cited in the background of the current invention.

Optionally, in another embodiment of present invention, the one-piece electrostatic discharge loop 8 shown in FIG. 1 can be tied or joined twice rather than once so as to form a first smaller loop, a second smaller loop and a third smaller loop, in such a way, the attachment mechanism 2 can be formed on the first smaller loop resting on an insole inside the shoe, the second smaller loop hitches onto the back portion of the shoe and the third smaller loop hitches onto the front portion of the shoe. In present embodiment, the front portion can be the instep portion, the back portion can be the heel portion.

Figure 2:
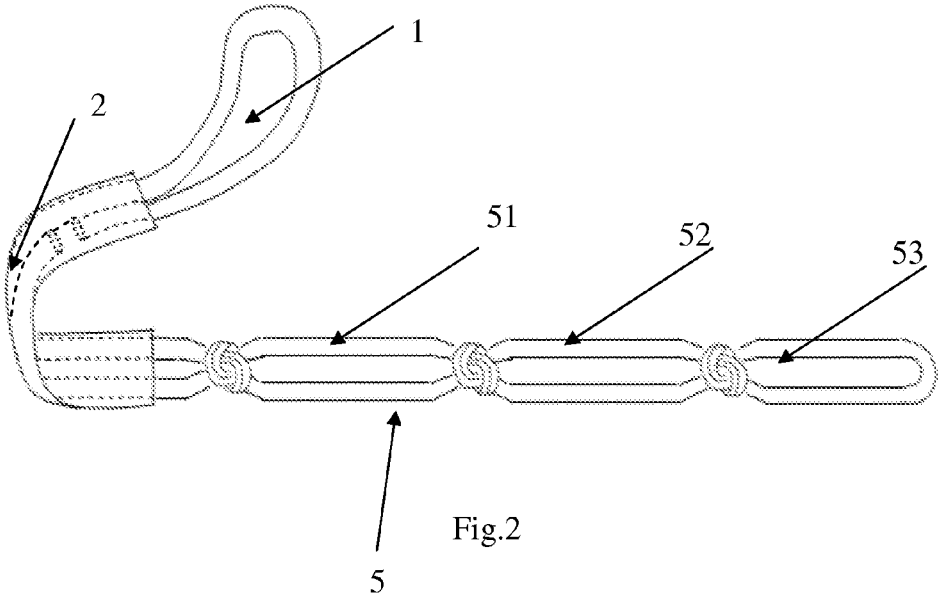
FIG. 2 is a diagram of a second embodiment of the electrostatic discharge shoe grounding accessory according to the present invention.

FIG. 2 is a diagram of a second embodiment of the electrostatic discharge shoe grounding accessory according to the present invention. In such embodiment, the one-piece continuous electrostatic discharge loop 8 comprises an attachment mechanism 2 and a fastening mechanism 5. The attachment mechanism 2 is a U-shape holder attached to back wall of an opening rim of the shoe. The fastening mechanism is an one-piece electrostatic discharge loop that is tied or joined three times so as to form a first smaller loop 1, a second smaller loop 51, a third smaller loop 52 and a fourth smaller loop 53. The U-shape holder is built into the first smaller loop 1 resting on an insole inside the shoe by mechanical attachment, sewing, sticking, molding or other method. When the electrostatic discharge shoe grounding accessory of the current invention is attached onto the shoe of a wearer, the heel portion of the shoe is hitched by the second smaller loop 51, the front portion of the shoe is hitched by the third smaller loop 52 and the extreme front portion (toe region) of the shoe is hitched by the fourth smaller loop 53.

One skilled in the art knows that, in other embodiment, the fastening mechanism 5 also can be an electrostatic discharge loop that is tied once, twice or more times so as to form two or more smaller loops, and different parts of the shoe can be hitched by such smaller loops. The present invention can not be limited by the number of the smaller loops.

When the electrostatic discharge shoe grounding accessory of the current invention is attached onto the shoe of a wearer, part of the one-piece continuous electrostatic discharge loop 8 is in direct contact with the bottom of a wearer's foot and another part of the loop is resting on a floor. Such an arrangement will facilitate the drainage of static charge from body-to-ground when a wearer is standing, walking or squatting on a conductive or electrostatic discharge flooring.

Figure 3:
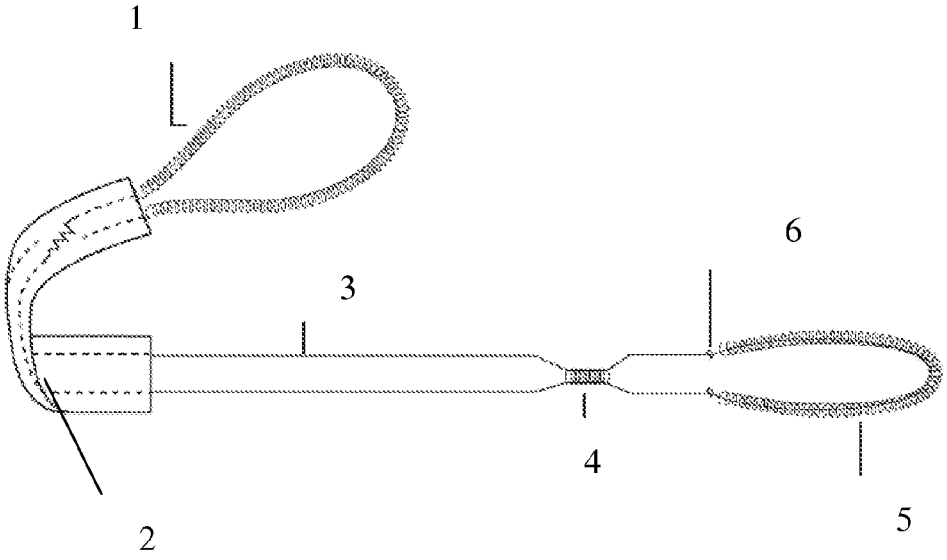
FIG. 3 is a diagram of a third embodiment of the electrostatic discharge shoe grounding accessory according to the present invention.

FIG. 3 is a diagram of a third embodiment of the electrostatic discharge shoe grounding accessory according to the present invention. Referring FIG. 3, the electrostatic discharge shoe grounding accessory comprises an attachment mechanism 2 and a fastening mechanism made of continuous spring, wire or spring plus wire to provide a flexible and extensible strap capable of fitting into various sizes of the footwear. The fastening mechanism comprises a tail portion 1 resting on an insole inside the shoe, at least one smaller loop 5 through which the front portion of the shoe is hitched, and a connection portion 3 connecting the tail portion 1 and the smaller loop 5. The attachment mechanism 2 is formed between the tail portion 1 and the connection portion. The tail portion 1 can be a conductive micro-spring loop, a wire or a piece of conductive polymer with an electrical resistance of less than 1×10e6 ohms measured according to ANSI/ESD S20.20 standard.

In present embodiment, the at least one smaller loop 5 can be a spring loop at the top front of the shoe installed with a "stretch-limit polyester braided rubber thread 6" to prevent the over-stretching of the top front spring loop that may lead to unwanted deformation if a worker accidentally over-stretches it while hitching the shoe strap onto the shoe. As shown in FIG. 3, the connection portion 3 may further comprises a micro spring 4 forming a loop at the front portion of the shoe and joining the rest of the connection portion 3.

As illustrated in FIG. 3, the portion of the fastening mechanism facing and contacting with the floor consist of one or two thin wire(s). It possesses the advantage of excellent cleanliness and will not cause any "slippery" of the shoe sole in retaining a proper grip on the floor during walking activity.

Of course, in certain application, a micro spring loop instead of the thin wire is used at the portion of the fastening mechanism facing and contacting with the floor to achieve a more elastic or more user-friendly comfortable pull when a worker is trying to hitch the strap onto the shoe.

Yet in certain application, the spring loop 5 at the top front of the shoe can be replaced by a thin wire design. A thin wire at the top front of the shoe can achieve an "invisible" look. This is useful where a worker wearing a pair of street shoes coming to work may not need to dismantle such electrostatic discharge shoe strap after work when he or she goes to the public places as it would not affect the original aesthetic look of the original shoe.

Figure 4:
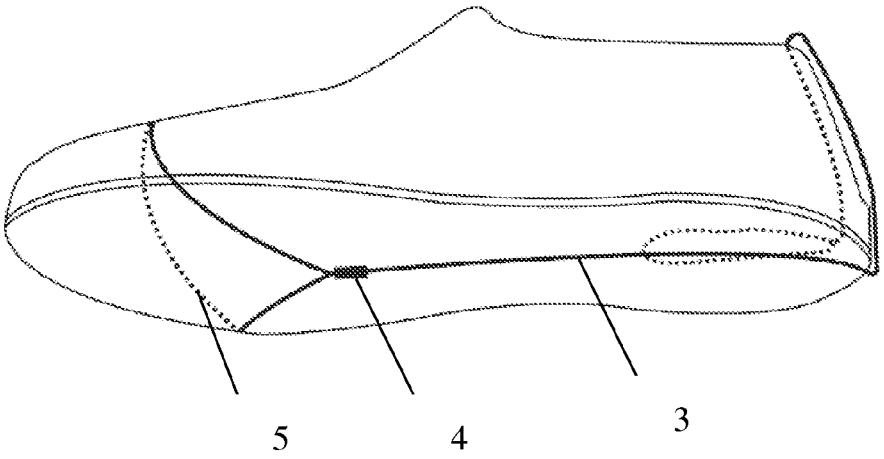
FIG. 4 is a diagram showing the fastened state of the electrostatic discharge shoe assembly according to the third embodiment of the present invention shown in FIG. 3.

FIG. 4 is a diagram showing the fastened state of the electrostatic discharge shoe assembly according to the third embodiment of the present invention shown in FIG. 3. As shown in FIG. 4, when the electrostatic discharge shoe grounding accessory of the current invention is attached onto the shoe of a wearer, the front portion of the shoe is hitched by the third smaller loop 5, the tail portion 1 is resting on an insole inside the shoe, the connection portion 3 is beneath the bottom shoe sole.

Figure 5:
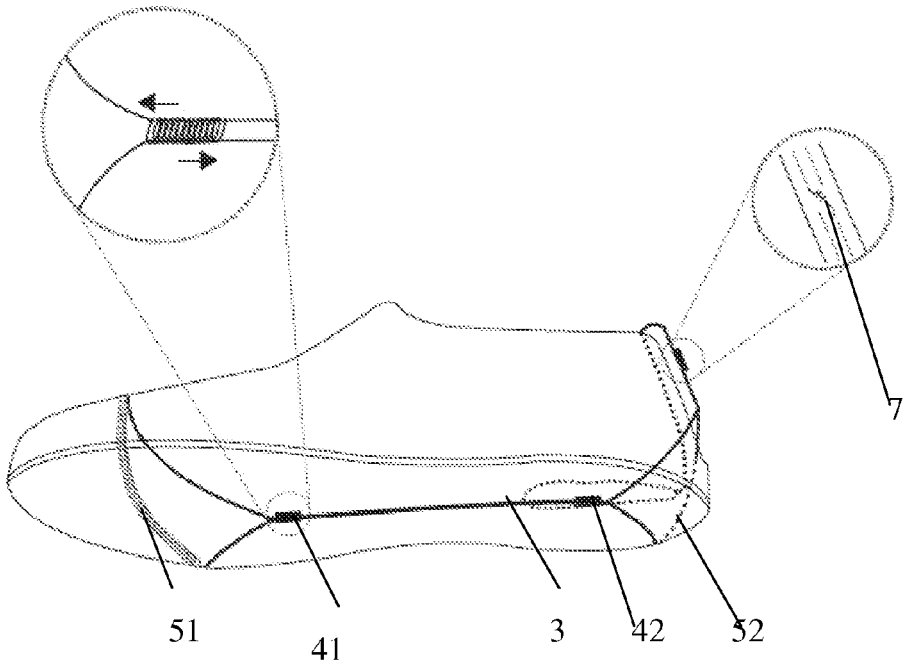
FIG. 5 is a diagram showing the fastened state of the electrostatic discharge shoe assembly according to a fourth embodiment of the present invention.
Figure 6:
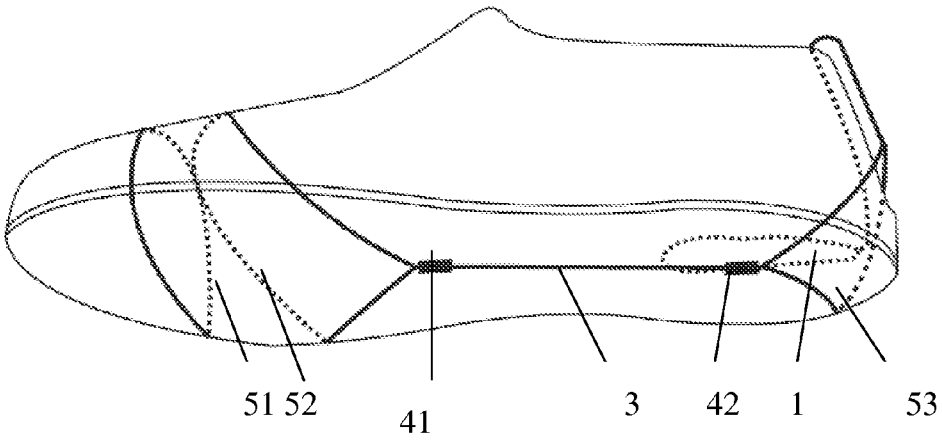
FIG. 6 is a diagram showing the fastened state of the electrostatic discharge shoe assembly according to a fifth embodiment of the present invention.
Figure 8:
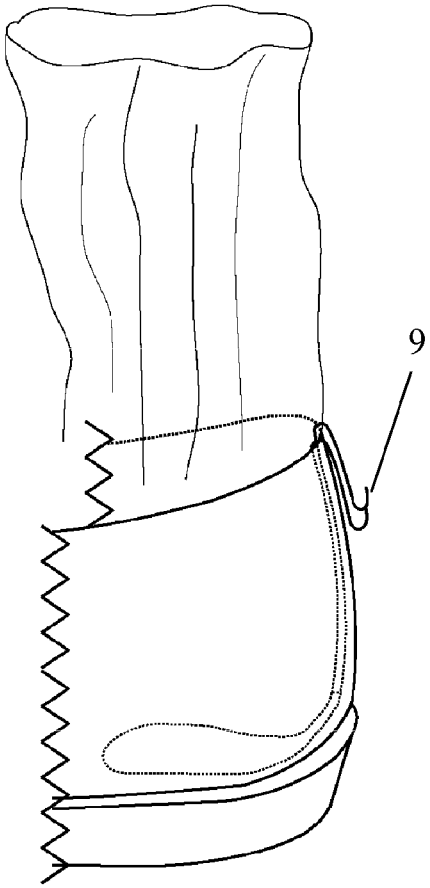
FIG. 7-11 are diagrams showing how the attachment mechanism according to a preferable embodiment of present invention formed.
Figure 7:
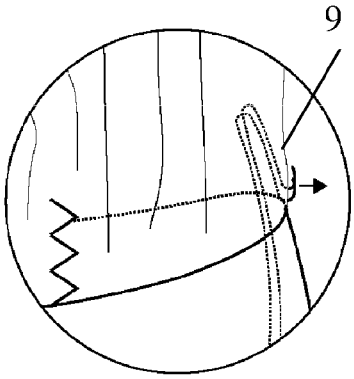
Figure 9:
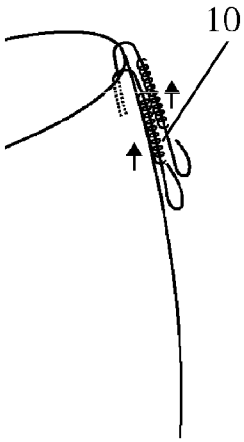
Figure 10A:
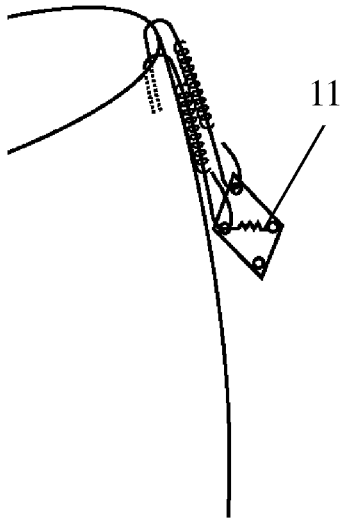
Figure 10B:
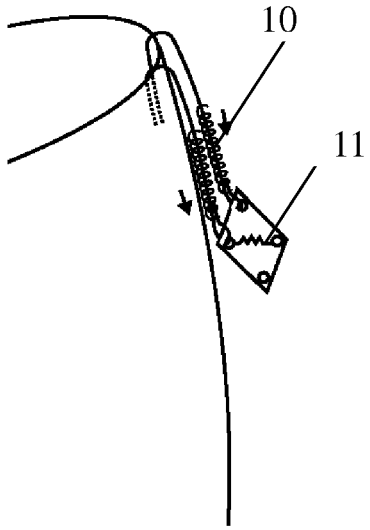
Figure 11:
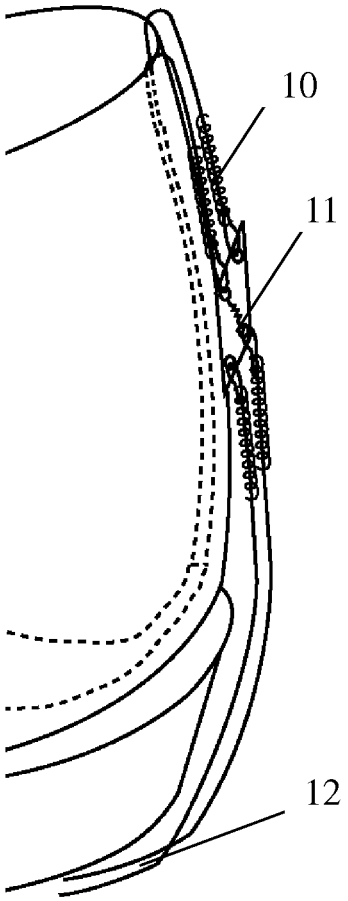

One skilled in the art know that, the fastening mechanism made of continuous spring, wire or spring plus wire can forms more smaller loops for hitching different portion of the shoe, which have been shown in FIG. 5-6. Referring FIG. 5, the fastening mechanism may forms a spring loop 51 through which the front portion of the shoe is hitched and a spring loop 52 through which the heel region of the shoe is hitched. In present embodiment, such smaller loops 51 and 52 are formed by a micro spring 41 and a micro spring 42.

Optionally, the smaller loops form by the fastening mechanism can be achieved by a cut slit, a knot, a micro-spring insertion or any other conventional means. A micro-spring insertion is preferred as it allows adjustment of the openings of the loop size whenever necessary to provide a more fitting design for hitching onto the shoe.

Optionally, a safety resistor 7 in series can be incorporated along the electrical path of the electrostatic discharge shoe assembly at the back wall heel region outside the shoe.

Referring FIG. 6, the fastening mechanism may forms a spring loop 51 through which the toe region of the shoe is hitched, a spring loop 52 through which the instep region of the shoe is hitched, a spring loop 53 through which the heel region of the shoe is hitched. In present embodiment, such smaller loops 52 and 53 are formed by a micro spring 41 and a micro spring 42. The smaller loop 51 can be formed by making an extra knot or joint at the spring loop around the top front of the shoe and hitch downward onto the toe region.

According a further embodiment of present invention, the attachment mechanism 2 is a U-shape holder attached to back wall of an opening rim of the shoe. As shown in FIG. 7-11, the U-shape holder comprises a steel wire with two sharp wire 9 ends for piercing through fabric just above a back wall heel region of the openings rim of a boot to form two small hooks 10 to hook up a resistor holder 11 electrically connecting the tail portion of fastening mechanism to its underneath portion 12 below the bottom of the shoe sole. While the present invention has been described with reference to several embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiment disclosed, but that the present invention will include all embodiments falling within the scope of the appended claims.

The invention claimed is:

1. An electrostatic discharge shoe grounding accessory, comprising an attachment mechanism and a fastening mechanism, wherein, the attachment mechanism is a U-shape holder attached to a back wall of an opening rim of a shoe, and the fastening mechanism includes at least one smaller loop through which a front portion of the shoe is hitched so as to form a Y-shape at the bottom of the shoe; wherein the fastening mechanism is a one-piece electrostatic discharge loop that is tied or joined three times so as to form a first smaller loop, a second smaller loop, a third smaller loop and a fourth smaller loop, wherein the attachment mechanism is formed on the first smaller loop resting on an insole inside the shoe, a back portion of the shoe is hitched through the second smaller loop, the front portion of the shoe is hitched by the third smaller loop, and an extreme front portion of the shoe is hitched by the fourth smaller loop.

2. An electrostatic discharge shoe grounding accessory, comprising an attachment mechanism and a fastening mechanism, wherein, the attachment mechanism is a U-shape holder attached to a back wall of an opening rim of a shoe, and the fastening mechanism is a one-piece electrostatic discharge loop that is tied or joined three times so as to form a first smaller loop, a second smaller loop, a third smaller loop and a fourth smaller loop, wherein the attachment mechanism is formed on the first smaller loop resting on an insole inside the shoe, a back portion of the shoe is hitched through the second smaller loop, the front portion of the shoe is hitched by the third smaller loop, and an extreme front portion of the shoe is hitched by the fourth smaller loop.

3. An electrostatic discharge shoe grounding accessory, comprising an attachment mechanism and a fastening mechanism, wherein, the attachment mechanism is a U-shape holder attached to a back wall of an opening rim of a shoe, and the fastening mechanism includes at least one smaller loop through which a front portion of the shoe is hitched so as to form a Y-shape at the bottom of the shoe, wherein the U-shape holder comprises a steel wire with two sharp wire ends for piercing through fabric just above a back wall heel region of the openings rim of a boot to form two small hooks to hook up to a resistor holder.

* * * * *